US011988398B1

(12) United States Patent
Damyanov

(10) Patent No.: US 11,988,398 B1
(45) Date of Patent: May 21, 2024

(54) UNIVERSAL VARIABLE MULTI FLOW SYSTEM

(71) Applicant: Deyan Damyanov, Burgas (BG)

(72) Inventor: Deyan Damyanov, Burgas (BG)

( * ) Notice: Subject to any disclaimer, the term of this patent is extended or adjusted under 35 U.S.C. 154(b) by 362 days.

(21) Appl. No.: 17/468,721

(22) Filed: Sep. 8, 2021

(51) Int. Cl.

| | |
|---|---|
| ***F24F 1/0007*** | (2019.01) |
| ***F24F 1/028*** | (2019.01) |
| ***F24F 1/032*** | (2019.01) |
| ***F24F 7/08*** | (2006.01) |
| ***F24F 11/80*** | (2018.01) |
| ***F24F 13/10*** | (2006.01) |
| ***F24F 110/10*** | (2018.01) |

(52) U.S. Cl.
CPC ..... *F24F 1/00073* (2019.02); *F24F 1/028* (2019.02); *F24F 1/032* (2019.02); *F24F 7/08* (2013.01); *F24F 11/80* (2018.01); *F24F 13/10* (2013.01); *F24F 2110/10* (2018.01)

(58) Field of Classification Search
CPC ..... F24F 1/00073; F24F 1/028; F24F 1/032; F24F 7/08; F24F 11/80; F24F 13/10; F24F 2110/10
USPC ..... 62/426
See application file for complete search history.

(56) References Cited

U.S. PATENT DOCUMENTS

| | | | | |
|---|---|---|---|---|
| 6,328,095 | B1 * | 12/2001 | Felber | F24F 3/1423 165/8 |
| 9,907,214 | B2 * | 2/2018 | Dagley | F24F 12/006 |
| 10,584,884 | B2 * | 3/2020 | Coutu | F24F 3/147 |
| 2020/0116372 | A1 * | 4/2020 | Fischer | F24F 12/003 |

* cited by examiner

*Primary Examiner* — Steve S Tanenbaum
(74) *Attorney, Agent, or Firm* — Michael D. Eisenberg

(57) ABSTRACT

A universal Variable Multi Flow system includes a hosing comprising a frame and a plurality of insulated panels; a fresh air inlet damper configured to regulate an air flow; a return air inlet damper; a fresh air inlet filter coupled to the fresh air inlet damper; a return air inlet filter coupled to the return air inlet damper; a counter flow plate heat exchanger with a bypass damper configured to extract cool/heat/humidity from the air; at least one supply and at least one return air fan configured to support circulation of the air through the VMF; a supply coil configured to re-cool or re-heat the air in separate enclosed areas; at least one brushless DC (BLDC) scroll compressor configured to produce warm or cold refrigerant; at least one variable frequency drive configured to control capacity of the at least one BLDC scroll compressor; and an Intelligent Control Box-Master Controller configured to control operations of the VMF system.

17 Claims, 4 Drawing Sheets

Inside Positioning VMF

UNIVERSAL VARIABLE MULTI FLOW SYSTEM

TECHNICAL FIELD

This application generally relates to controlling environment in the enclosed area, and more particularly, to a universal Variable Multi Flow (VMF) system.

BACKGROUND

Maintaining a correct level of humidity, temperatures and ventilation inside homes or offices is very important for comfort and health of occupants. Providing correct environment in medical facilities, labs, inside the computer rooms or data centers is even more critical.

Conventional so called Classic Air-handling Units (AHUs) have employed for years using large variety and different configurations, depending on project requirements. The main goal of AHUs is to treat Fresh Air only (up to 100%) for users' needs in closed conditioned rooms. Typically, the heating/cooling sources for the AHU coils are External for the unit, such as: chillers (water), VRF condensing unit (refrigerant), boiler (gas, wood, etc.), central heating/cooling, etc. The AHU's are controlled by autonomous automation systems that are separate/different from their heat/cool sources.

The AHUs with two stage heat recovery or Hybrid AHUs have been employed in for over a decade. These AHUs are improved versions of the classic AHUs, where the heat/cool source is not external, but built-in to the unit. The built-in heat/cool source (i.e., a reversible heat pump) works with air recovered from the room (i.e., extract air). It is controlled by a common automation system. The built-in heat/cool source (i.e., the reversible heat pump) is often not sufficient at ambient temperatures ≤−10° C. or ≥35° C. An additional/external source needs to be added for covering the peak temperatures. Regardless of the improvements, in comparison to the classic AHU, the Hybrid AHU are also designed mainly for Fresh Air treatment only (up to 100%), and the Cooling Loads/Heating Losses need to be covered by other heat/cool sources.

So called Rooftops are a combination of Classic and Hybrid AHUs with the following differences. The built-in heat/cool source (i.e., reversible heat pump) works with ambient air mainly, which determines the outside position of the unit. It is controlled by a common automation system. The main limitation of the Rooftops is that they treat mainly recirculation air and can cover entirely the Cooling Loads/Heating Losses, but cannot treat up to 100% of the fresh air needed for ventilation at the same time. The Rooftops normally treat up to 30-50% fresh air, and due to this fact do not have Energy-Recovery (e.g., a plate or rotary heat exchanger). Besides that, at ambient temperatures ≤−10° C. or ≥35° C., the Rooftop source is not sufficient, and additional/external source needs to be added for covering the peak temperatures.

Yet other conventional alternatives are VRVs/VRFs. These are Direct Expansion (DX) systems with Variable Refrigerant Volume (Flow). They are split type systems with a few external and many internal units, depending on the size of the project. The external unit serves for a thermal treatment of the refrigerant (cooling/heating) and via pipe system (2, 3 or 4 pipes) it transports it to the internal units that cool/heat the air in the room (work with recirculation air only).

The external unit works with ambient air only, which determines the position of the unit—outside. The variety of the internal units is large, depending on the design and needs of the rooms. It is controlled by a common automation system. At ambient temperatures ≤−20° C., the capacity of the external unit is often not sufficient and expansion of the external unit to 20-30% of additional capacity is necessary. Another main disadvantage is the long distance between the external and internal units, which leads to limitations of the distance (in both length and height) and to substantial hydraulic/pressure losses and respectively losses of useful Heat/Cool capacity. This in turn may leads to expansion of the external unit with 20-30% of capacity to cover these losses. This is a waste of useful heat/cool capacity and energy.

As a modification and improvement of the above described VRVs/VRFs are so called Heat Recovery VRFs. They have the same characteristics as the above described VRFs, plus additional added functionality—Domestic Hot Water (DHW). These systems have limitations in terms of the useful heating/cooling capacity (up to 15-16 kW) and are mainly used for houses and residential buildings. Another limitation is that the system works on OR principle, which means that either heat DHW OR Cool/Heat operates, but both functions cannot be performed simultaneously. As a result each function and its set point are lagging behind and the system needs to catch up constantly.

Maintaining microclimate (temperature and relative humidity) in closed rooms presents the following main problems:

There is no single common (unified) system or concept or solution, that can provide all functionalities needed for people in closed rooms—i.e., Heating, Cooling, Ventilation and Sanitary Hot Water (DHW)) simultaneously. There are products which combined together the elements that can cover the main functionalities, but it is done in a very inefficient and costly way. What the HVAC means is often misunderstood. The end users think that Heating and Air-Conditioning systems also provide Ventilation, and vice versa. There are large areas around the world where, Ventilation system is completely missing (only AC or Heating is available).

The above described main problems lead to the following sub problems:

Heating/Air-Conditioning Systems provide the necessary quantity of heat and/or cool and respectively they cover the Cooling Loads/Heating Losses into the rooms. They work completely with recirculation air (i.e., re-circulate and heat/cool the same air from the room) or partially can treat some quantity of fresh air (up to 30%, but never 100%) for the people. These systems work based on the split system principle, where there is an external unit (source of heat/cool) and internal units that treat the air from the room. Examples of such split systems are: Boiler radiators, heat pump/chiller-fan coils, VRV/VRF-cassettes, etc.

Ventilation systems provide the necessary quantity of fresh air (up to 100%) for the people in closed rooms, and most often are designed based of the maximum amount of people (for comfort ventilation) or other sanitary norms. Those systems also work based on the split system principle, where Ventilation unit is located in one place (outside or inside), and the source needed for cooling/heating of the fresh air is located somewhere else and the connection between them is made through pipes and pumps. The transfer of the fresh air from ventilation unit to the closed room is made through air ducts and grilles.

Domestic Hot Water (DHW) system—in most cases is completely different from the main Heating/Cooling systems. In the hot and sunny areas of the world, sun panels are most widely used. However, in the northern parts of the world people rely on traditional sources for heating the water such as gas, firewood, central heating and even coal. In the mild-climate areas, even more complicated systems are used, such as a combination of sun panels and traditional, which are complicated and expensive.

At very low ambient temperatures (Tamb≤−15° C.), very often the source of heat is more than a single source, and the second source is used only at critical temperature values. In most cases, both sources are different and, for example, if the first one uses the energy of the ambient air, the second one could use back-up Electric, gas, central heating or others. Very often the end users do not make a distinction between the two systems and do not realize the need for both. That is why very often one of the systems (most often the Ventilation) is completely missing, which is improper. The presence of both systems (Heating/Cooling and Ventilation) leads to the necessity of a superior upper level of automation system. Each of the systems has its own automation system (i.e., a controller) and very often the communication between them is inefficient or there is no proper communication protocol that leads to the need for a higher-level of automation system to synchronize and control the units. These are so called BMS (Building Management Systems), which are very complicated and expensive to implement.

One of the functionalities of the BMS is to track/follow the presence of people in the rooms, and based on that (respectively with a lack of people) to either minimize or completely switch off the Ventilation system. The effect in this case is that the end user pays high initial investment costs for two systems, plus BMS, but practically one of the systems, together with its duct system (which is expensive and occupies the useful space of the building) is used very rarely and is inefficient.

As described above, both systems are based on the split system principle, where the source of heat/cool works with different fluids such as water, refrigerant, gas, steam, etc. That complicates the process and makes the entire system expensive, where the systems work with different fluids. That leads to different pipe connections, presence of pumps, fittings, etc.

The presence of separate systems for Heating, Cooling, Ventilation and Domestic Hot Water (DHW) requires significantly larger footprint for installation, which makes it expensive and takes away from useful spaces. Usually such spaces are required on the roofs, machinery rooms, basements, garages, etc. Another limitation is the fact that these systems use ambient air as a source of heat/cool, and they need to be installed outside. For many buildings that might be a serious problem. In most cases these different systems are delivered by different manufacturers or suppliers/dealers. When any sort of a problem occurs within the common system, a responsibility "transfers" from company to company and the one who suffers is the end user. The above described problem leads to complicated and expensive service and maintenance contracts and to using different service companies at the same time.

Installed Electric Power input means a presence of 2 or 3 separate systems, where one of them very often does not work due to savings of electric energy. This leads to significant over sizing of the required electric power input capacities, which leads to more expensive initial investments and to the exploitation costs.

Geographical separation and limitations are cause by many different climate zones with specific climate conditions. This requires the Heating, Air-Conditioning, Ventilation and DHW systems to be designed based on the specific needs of each region. Many of the existing systems have ambient temperature limitations (for example dawn to −15° C. or up to +35° C.). This requires customization for each system that is intended for specific climate zone and is therefore more expensive.

Accordingly, what is needed is an efficient universal Variable Multi Flow (VMF) system that overcomes the shortcomings and limitations of the existing systems.

SUMMARY

An example embodiment provides a universal VMF system that includes a hosing comprising a frame and a plurality of insulated panels; a fresh air inlet damper configured to regulate an air flow; a return air inlet damper; a fresh air inlet filter coupled to the fresh air inlet damper; a return air inlet filter coupled to the return air inlet damper; a counter flow plate heat exchanger with a bypass damper (or rotary type heat exchanger) configured to extract cool/heat/humidity from the room air; at least one supply and at least one return air fan configured to support circulation of the air through the VMF; a supply coil configured to re-cool or re-heat the air in separate enclosed areas; an extract coil configured to additionally recover the heat from the room, at least one condenser/evaporator coil configured to extract heat of the ambient air, at least one brushless DC (BLDC) scroll compressor configured to produce warm or cold refrigerant; at least one variable frequency drive configured to control capacity of the at least one BLDC scroll compressor; and an Intelligent Control Box-Master Controller configured to control operations of the VMF system.

DETAILED DESCRIPTION

Figure 1:
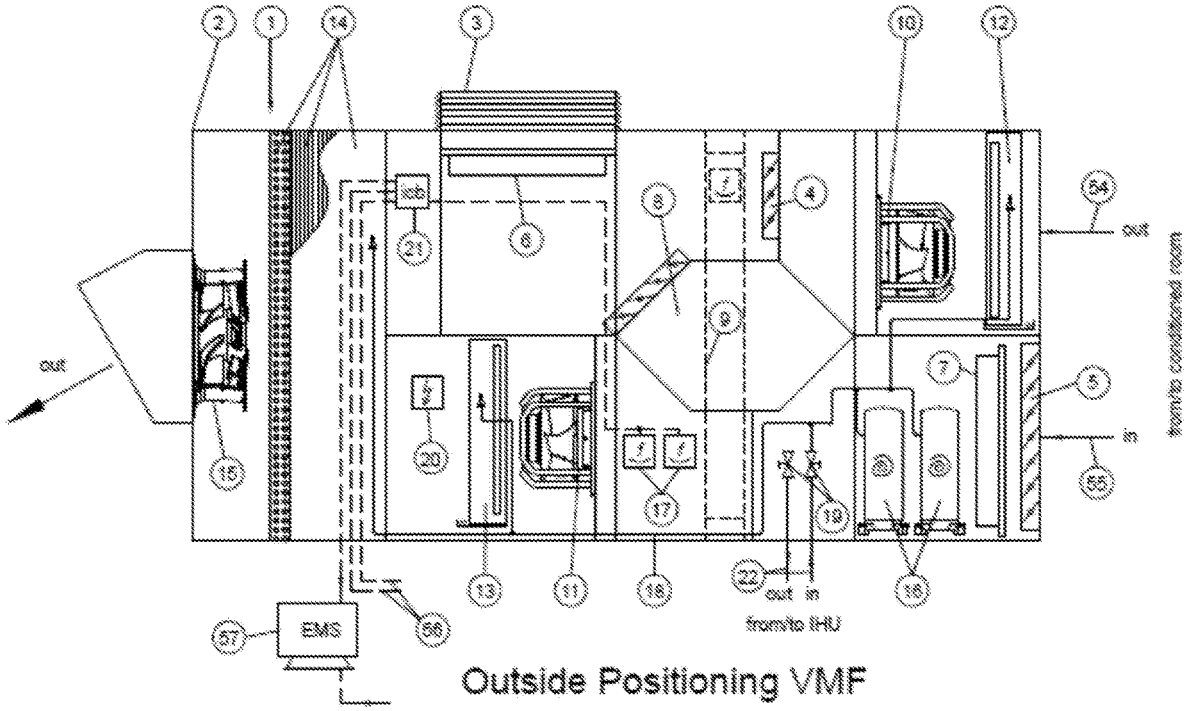
FIG. 1 illustrates an outside positioning of VMF system, according to example embodiments.

It will be readily understood that the instant components, as generally described and illustrated in the figures herein, may be arranged and designed in a wide variety of different configurations. Thus, the following detailed description of the embodiments of at least one of a method, apparatus, non-transitory computer readable medium and system, as represented in the attached figures, is not intended to limit the scope of the application as claimed but is merely representative of selected embodiments.

The instant features, structures, or characteristics as described throughout this specification may be combined or removed in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment. Thus, appearances of the phrases "example embodiments", "in some embodiments", "in other embodiments", or other similar language, throughout this specification do not necessarily all refer to the same group of embodiments, and the described features, structures, or characteristics may be combined or removed in any suitable manner in one or more embodiments. Further, in the diagrams, any connection between elements can permit one-way and/or two-way communication even if the depicted connection is a one-way or two-way arrow. Also, any device depicted in the drawings can be a different device. For example, if a mobile device is shown sending information, a wired device could also be used to send the information.

In addition, while the term "message" may have been used in the description of embodiments, the application may be applied to many types of networks and data. Furthermore, while certain types of connections, messages, and signaling may be depicted in exemplary embodiments, the application is not limited to a certain type of connection, message, and signaling.

Example embodiments provide system and components, which provide for implementation of a universal VMF.

The ventilation requirements may be based on ventilation per person or per square foot while keeping the ventilation to a minimum. The exemplary embodiments work with maximum amount of fresh air per person without following CO2 levels. The exemplary VMF system maximizes fresh air and can work in a wide temperature range of −30° C.<T<50° C. Thus, the VMF system is designed for most locations such as offices, hotels, hospitals, or any other multi-zone environments with multiple rooms.

According to the exemplary embodiments, the system can heat one room and cool another at the same time. In one embodiment, balanced ventilation may supply and extract air. The following components and numbering are used in the description that follows.

1. VMF External unit;
2. Body (Aluminum frame and insulated panels);
3. Fresh Air intake rain hood;
4. Fresh air inlet damper (i.e., a door that regulates air flow from 0 to 100%);
5. Return air inlet damper;
6. Fresh air inlet filter;
7. Return air inlet filter;
8. Counter flow plate heat exchanger with bypass damper (fixed);
9. Rotary wheel with variable frequency drive (VFD);

Note that units 8 and 9 are alternatives to each other and only one of them may be used as a heat recovery device.

10. Supply air fan;
11. Return air fan of VMF Unit;
12. Supply coil for additional fresh air treatment—for cooling and heating in different rooms—DX air heat exchanger;
13. Extract coil for additional heat recovery—adds to recover heat from the room to make recovery close to 100%;
14. Evaporator/Condenser Coil (1 or 2 pcs.);
15. Axial fan(s) for refrigerant circuit;
16. BLDC (brushless DC) scroll compressor(s)—refrigerant compressor always produces warm or hot refrigerant (40° to 105° C.);
17. Variable frequency drive(s) for BLDC scroll compressor(s)—control the capacity of compressor;
18. Internal Copper pipes connecting refrigerant circuit components within VMF unit;
19. Refrigerant inlet/outlet valves;
20. Power supply electric box;
21. ICB (Intelligent Control Box)-Master Controller;
22. External Refrigerant copper pipes, connecting VMF unit and IHU;
23. IHU (Internal Hydraulic Unit)—refrigerant does not go into the conditioned rooms;
24. Refrigerant/Water plate heat exchanger;
25. Electronic Expansion valve;
26. IHU Controller-slave;
27. IHU circulation pump;
28. Floor circulation pump(s);
29. Gathering water collector;
30. Distribution water collector;
31. Additional expansion vessel;
32. Balance valve (manual);
33. Two-way balance valve with actuator;
34. Three-way mixing valve with actuator;
35. Two-way regulating valve;
36. Hot water tank Domestic Hot Water (DHW);
37. DHW supply pipe;
38. DHW return pipe;
39. Machinery or Bath or any other non-conditioned room inside the building;
40. Water inlet/outlet pipes;
41. Conditioned room;
42. Internal Unit (IU)—each room is handled by one or more IUs;
43. IU Controller-slave;
44. Temperature Sensors;
45. Two-way regulating valve with actuator;
46. Mixing Box;
47. Return air recirculation grill;
48. Supply air grilles Internal Unit;
49. Supply air distribution ducts;
50. Supply air regulating valve with actuator;
51. Return air regulating valve with actuator;
52. Extract air grille (s);
53. Room Thermostat/Room Temperature sensor;
54. Supply Air main ducts;
55. Return Air main ducts;
56. Electric and Communication (ModBus) lines;
57. EMS (Energy Management System)/Central Operator Station.

Figure 2:
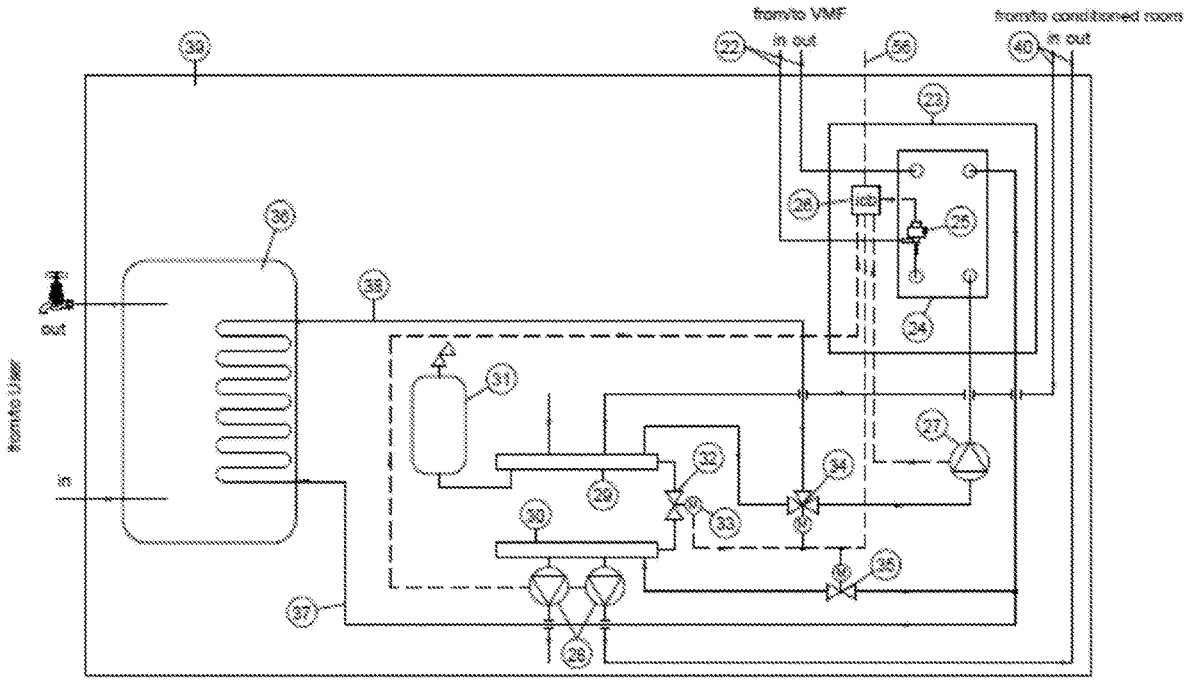
FIG. 2 illustrates an infrastructure of an internal machinery room, where IHU and Sanitary Hot water system are located.
Figure 3:
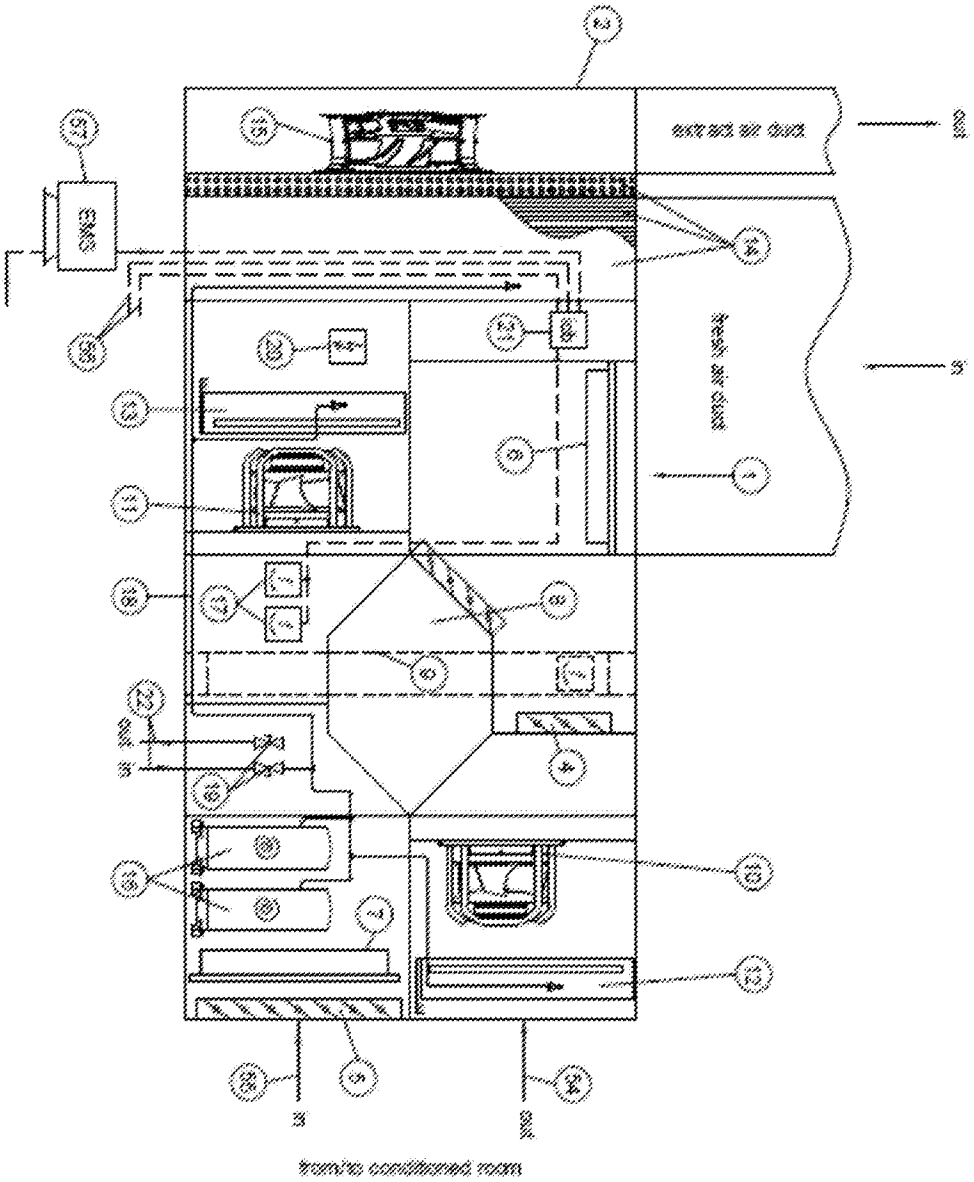
FIG. 3 illustrates an inside positioning of the VMF, according to example embodiments.

According to the exemplary embodiments, in Heating mode—refrigerant goes directly to THU 23 (see FIG. 2). In Cooling mode—refrigerant goes to Internal Copper pipes 18 (FIGS. 1 and 3) connecting refrigerant circuit components within VMF unit and Evaporator/Condenser Coil 14 (FIGS. 1 and 3) where the heat goes to ambient and then to Refrigerant/Water plate heat exchanger 24 (FIG. 2). The Refrigerant/Water plate heat exchanger 24 is used as condenser or evaporator, depending on heating or cooling mode, units 12 and 14 are dual mode heat exchangers.

The cool-heat mode uses water for cooling and ambient air for heating (majority of rooms need to be cooled).

The heat-cool mode uses water for heating and ambient air for cooling (majority of rooms need to be heated).

Supply air regulating valve with actuator 50 (FIG. 4) and return air regulating valve with actuator 51 are initially closed to get to a certain room temperature near set point. IU has has air to water heat exchanger, integral part of it. Then, valves 50 and 51 are opened for ventilation.

According to the exemplary embodiments, heating/cooling may be implemented along with sanitary hot water. Heating+hot water—i.e., through three-way mixing valve with actuator 34 and two-way regulating valve 35, the water is regulated within the necessary proportions and distributed into the room for heating. Cooling+hot water—hot refrigerant goes to unit 23 (FIG. 2).

In one embodiment, refrigerant goes to unit 12 (FIG. 3), where cooling is done by fresh air.

General (Variable Multi Fluid) is implemented as follows.

1. 1 pcs. VMF (Variable Multi Fluid total HVAC) system 1 (FIG. 1), which could be located either outside, but also inside the conditioned building;
2. 1 pcs. IHU (Internal Hydraulic Unit) 23 in FIG. 2, located inside the building in Machinery or Bath room, or any other non-conditioned room;
3. From 1 up to maximum 42 IU (Internal Unit) 42 in FIG. 4, located inside of conditioned room 41.
4. 1 pcs. Hot water tank 36 in FIG. 2, located inside the building in Machinery or Bath room, or any other non-conditioned room.
5. All above positions are located/installed and are power and communication supplied.

In one embodiment, Workings/Operation Mode—Variant 1 (Heating+Cooling+Ventilation) is implemented.

Figure 4:
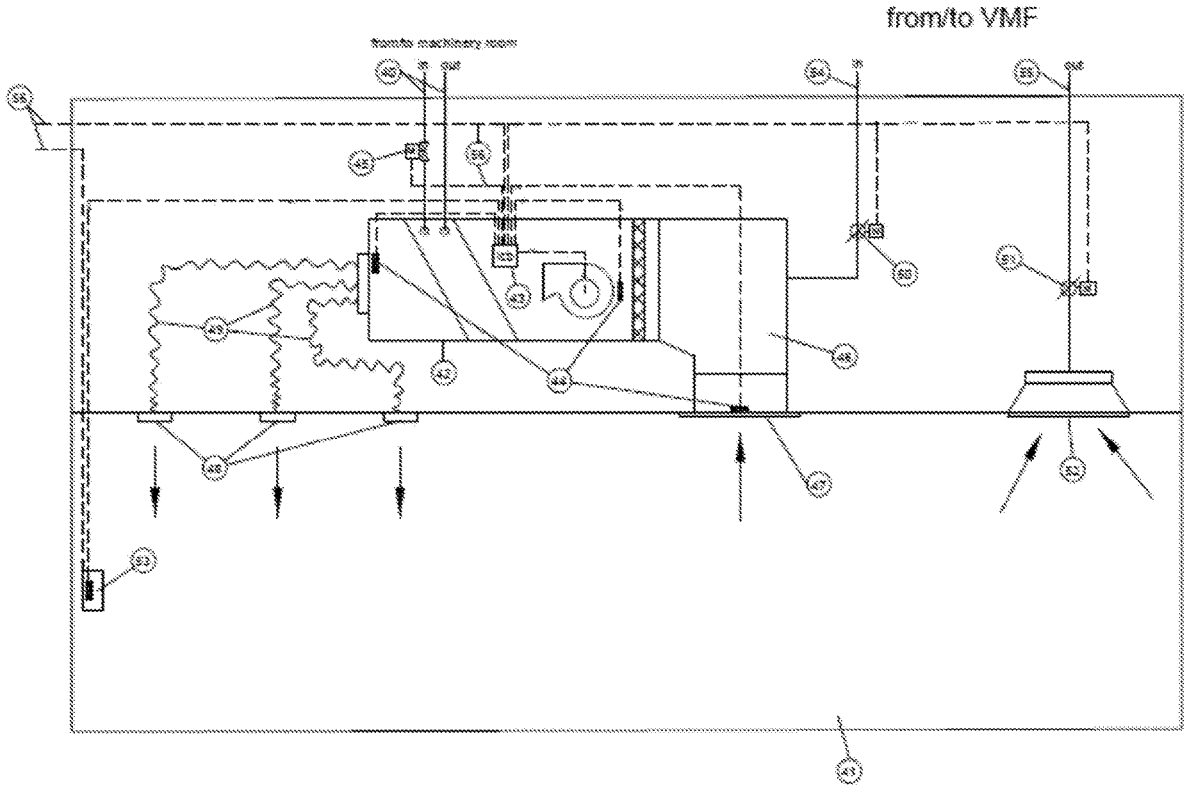
FIG. 4 illustrates an infrastructure of an internal closed conditioned room.

The users are in different conditioned rooms 41 in FIG. 4 may set the desired room temperature via Room Thermostat/Room Temperature sensor 53 (FIG. 4), or Operator through EMS (Energy Management System)/Central Operator Station 57. This info gets to IU Controller-slave 43 in FIG. 4 and from there is redirected via Electric and Communication (ModBus) lines 56 in FIG. 4 to ICB (Intelligent Control Box-Master Controller 21 in FIG. 1). The Master Controller 21 may summarize the information from all Internal Units (IU) 42 in FIG. 4 and their individual modes (which are determined by the temperature difference between the user-set Set Point and real measured moment temperature value, measured by Room Thermostat/Room Temperature sensor 53) and may then determine the VMF Concept (Variable Multi Fluid total HVAC) system 1 mode.

At start up: In FIG. 1, axial fan(s) for refrigerant circuit 15 start and activate Evaporator/Condenser Coil (1 or 2 pcs.) 14, BLDC scroll compressor(s) 16 and Variable frequency drive(s) for BLDC scroll compressor(s) 17 and, thus, start the heating or cooling of the refrigerant. The treated refrigerant is transported to IHU (Internal Hydraulic Unit) 23 via opened Refrigerant inlet/outlet valves 19 and External Refrigerant copper pipes connecting VMF unit and IHU 22. The refrigerant reaches Refrigerant/Water plate heat exchanger 24. The exchanger has 2 inlet/outlets for refrigerant and 2 inlet/outlets for water. The transformation of refrigerant heat/cold into water occurs in the exchanger. The quantity of the refrigerant and respectively the cooling/heating capacity of the plate heat exchanger are regulated by Electronic Expansion valve 25. In cooling mode, the exchanger works as an evaporator, and in heating mode—as a condenser. After the refrigerant's heat/cold is projected into the water, the refrigerant via External Refrigerant copper pipes connecting VMF unit and IHU 22 goes back into VMF (Variable Multi Fluid total HVAC) system 1. The water that has just taken the cold/heat from the refrigerant is then transported via IHU circulation pump 27 to a Distribution water collector 30. From there, via Floor circulation pump(s) 28, the water is transported to the conditioned room(s) 41.

In FIG. 4, water reaches first two-way regulating valve with actuator 45 (where its quantity is regulated) and then enters the coil of the Internal Unit 42 for heating/cooling. After the water temperature reaches certain value, close to its Set Point, the fan of the Internal Unit 42 starts workings. The fan of the Internal Unit sucks recirculation air via Return air recirculation grill 47. The recirculation air is cooled/heated in the coil and then passed on to Supply air grilles 48 via Supply air distribution ducts 49 and is distributed into the conditioned room 41. Until this moment, the Internal Unit 42 cools/heats recirculation air only, without any fresh air.

When the momentary value of room temperature, measured by Room Thermostat/Room Temperature sensor 53 approaches closest to the Set Point, then the fresh air is supplied into the conditioned room. IU Controller-slave 43 sends info/request to the ICB (Intelligent Control Box—Master Controller 21, after which fresh air is introduced into 1 via Fresh Air intake rain hood 3 (see FIG. 1). The fresh air goes through fine filtration in Fresh air inlet filter 6, then passes through Counter flow plate heat exchanger with bypass damper 8 or Rotary wheel with variable frequency drive (VFD) 9, where the air recovers heat/cool/humidity from the extract air from the room. The air recovery capacity is regulated either by bypass damper and fresh air inlet damper 4 for 8 or by variable frequency drive (VFD) for 9.

Then, the fresh air goes via Supply coil for additional fresh air treatment 12 shown in FIG. 1 (only if necessary), and the air is transported to the conditioned room 41 through Supply air fan 10 via Supply Air main ducts 54. The air reaches Supply air regulating valve with actuator 50, where its quantity is regulated, and then supplied to Mixing Box 46. In that box, a mixing of recirculation air with the fresh air occurs, and then the mixed air goes into the Internal Unit 42 for additional cooling/heating. At the same time the extract air from the room is being sucked from return air fan 11 and via Extract air grille(s) 52 consecutively goes through Return air regulating valve with actuator 51 (where its quantity is regulated), and via Return Air main ducts 55 goes back to the system 1.

Further in FIG. 1, the air, through open Return air inlet damper 5, enters into Return air inlet filter 7 for fine filtration and then goes through Counter flow plate heat exchanger with bypass damper 8 or through Rotary wheel with variable frequency drive (VFD) 9, where it rejects its heat/cool/humidity. The air passes further though Extract coil 13 for additional heat recovery (only if necessary) and then, via return air fan 11, the air is extracted to the atmosphere or sucked through Evaporator/Condenser Coil (1 or 2 pcs.) 14 from the axial fan(s) for refrigerant circuit 15, where it rejects its heat and then is extracted into the atmosphere.

Workings/Operation Modes—Variant 2 (Heating+Cooling+Ventilation+DHW) is implemented as follows.

When Sanitary Hot Water (DHW) is presented/active together with the other functionalities, the desired hot water temperature for DHW is set by the Operator through EMS (Energy Management System)/Central Operator Station 57 (FIG. 3), and users set the desired room temperature in different conditioned rooms 41 through Room Thermostat/Room Temperature sensor 53. The DHW Set Point temperature usually takes priority over the Temperature set for Hot water for heating, because at all time it has higher value.

In one embodiment, simultaneous DHW+Heating+Ventilation are provided.

The desired DHW set point becomes priority for VMF 1 over Temperature set for Hot water for heating. The VMF 1 continues to operate the same way described above in Variant 1, with the following differences: after the heat of condensation of the refrigerant is transformed into hot water in Refrigerant/Water plate heat exchanger 24, the water is regulated within the necessary proportions through 3 way mixing valve with actuator 34 and 2 way regulating valve 35 and then distributed to system 1. The water goes through Hot water tank 36 via DHW supply pipe 37 and to 2. Then the water goes through Distribution water collector 30, where through Floor circulation pump(s) 28 the water is transported to Internal Units 42 (see FIG. 4). After the water cools down to a certain degree, the water from Hot water tank 36 via DHW return pipe 38 and from Internal Units 42 is mixed in three-way mixing valve with the actuator 34 and is sucked by IHU circulation pump 27 and then transported back to the Refrigerant/Water plate heat exchanger 24 for the same cycle of operation.

In one embodiment, simultaneous DHW+Cooling+Ventilation may be implemented. The desired hot water temperature for DHW is set by the Operator through Energy Management System (EMS)/Central Operator Station 57 (FIG. 3), and Users set the desired room temperature in different conditioned rooms 41 through Room Thermostat/Room Temperature sensor 53. VMF 1 through BLDC scroll compressor(s) 16 produces hot refrigerant, and the refrigerant heat of condensation is transformed into hot water in Refrigerant/Water plate heat exchanger 24. The two-way regulating valve 35 is closed, which helps the entire water volume to go to Hot water tank 36 via DHW supply pipe 37 (FIG. 2). After the water cools down to a certain degree, the hot water from Hot water tank 36 via DHW return pipe 38 and three-way mixing valve with actuator 34 is sucked by IHU circulation pump 27 and then returns back to the Refrigerant/Water plate heat exchanger 24 for the same cycle of operation. At the same time conditioned rooms 41 are being cooled by using fresh air (ventilation).

The Fresh air is sucked by Supply air fan 10 and consecutively goes through Fresh Air intake rain hood 3, fine filtration in Fresh air inlet filter 6, and then is pre-cooled and dehumidified in Counter flow plate heat exchanger with bypass damper 8 or Rotary wheel with variable frequency drive (VFD) 9. It is then re-cooled and additionally dehumidified in Supply coil for additional fresh air treatment 12 and via Supply Air main ducts 54 and transported to the Conditioned rooms 41. The air reaches Supply air regulating valve with actuator 50, where its quantity is regulated and then supplied to Mixing Box 46. In the Mixing Box 46, a mixing of recirculation air from the room and cooled and dried fresh air occurs. The air mixture goes to the Internal Unit 42, where through the built-in fan it is transported via Supply air distribution ducts 49 and Supply air grilles 48 to the conditioned rooms 41.

The system, according to the exemplary embodiments, advantageously, creates one universal concept, which provides simultaneously Heating, Cooling (covering cooling loads and heating losses), Ventilation (Fresh Air treatment up to 100%) of the premises, and Domestic Hot Water (DHW) in temperature range of the ambient air −30° C. to +50° C. with only 1 external unit (VMF). The system provides multiple advantages over any known systems or combination of the known systems, and addresses their disadvantages at the same time.

In particular, the exemplary system is:

- multi fluid (to treat simultaneously 3 different fluids): Refrigerant, Water and Fresh Air;
- able to produce Domestic Hot water, Heat/Cool and Ventilate the conditioned rooms simultaneously;
- installed and works in both: outside, but also inside the building (without access to ambient air and without any limitations in the external static pressure (Pa));
- configured to use 2 pipe (water and refrigerant) system with possibility for simultaneous heating, cooling and ventilation in different conditioned rooms (multi-zone HVAC);
- configured to ensure continuous work during frost forming conditions;
- configured to have no limitations for maximum length and/or height between the VMF (External Unit) and internal units;
- configured to work irrespective of concentration/content of CO2 in the conditioned rooms, but to work always with maximum amount of fresh air (calculated on the basis of maximum amount of people in the room);
- configured to ensure Full Automatic Control of the room temperature in conditioned rooms, without possibility for manual speed control and cool/heat switch from the users;
- configured to ensure Refrigerant-free conditioned rooms, and no refrigerant leak-detector thermostats (which are mandatory), by using water as main fluid within the building;
- configured to ensure no glycol in the water system, by placing the Internal Hydraulic Unit within the building;
- configured to use significantly lesser quantity of refrigerant, compared to existing VRF systems;
- configured to provide Free-Cooling Mode (where the room temperature is maintained mainly by using fresh air, without mechanical cooling);
- configured to have Emergency Mode—when the water system does not operate (due to miscommunication between Controllers, malfunctioned pump(s) or others)—it stops treatment (cooling/heating) of the water to the internal units. The internal units continue to work with a mixture of fresh air (cooled/dehumidified or heated) and recirculation air. The full capacity of the VMF is being transferred from Water to fresh air and the system continues to operate till solving the problem;
- configured to have significantly less required installed electric power input, in comparison to all existing VRFs+AHUs;
- configured to require significantly less (2 times or more) footprint for positioning and installation in comparison to all existing VRFs+AHUs;
- configured to require significantly less time for: designing, equipment selection, Installing, Start-up and commissioning and Service in comparison to all existing VRFs+AHUs;
- configured to avoid noise in the pipe system (usually coming from movement and regulation of the refrigerant, typical for existing VRF systems);
- configured to have significantly less electronics and executive mechanisms in its automation system, in comparison to all existing VRFs+AHUs and to ensure higher reliability;
- configured to remove the need of BMS (Building Management System), which is integral part of all existing VRFs+AHUs;
- configured to provide lower (4-6 dB) sound noise level, in comparison with all existing VRFs+AHUs, due to the noise sources of VMF are all located and concentrated inside the unit protected by heat and sound insulted by panels, instead of being are spread all over the building.

Example implementation is depicted in the FIGS. 1-4.

In FIG. 1, VMF (Variable Multi Fluid) concept includes: VMF (External Unit) 1 and minimum one Internal Unit 42, one Internal Hydraulic Unit (IHU) 23 and one Hot Water Tank 36, which are connected to VMF (External Unit) 1 through External Refrigerant copper pipes, connecting VMF unit and IHU 22, Water inlet/outlet pipes 40, DHW supply pipe 37 and DHW return pipe 38 and Electric and Communication (ModBus) lines 56.

Fresh air is introduced through Fresh Air intake rain hood 3, which is mounted on the Body (Aluminum frame and insulated panels) 2 of the VMF External unit 1. Then the air passes through Fresh air inlet filter 6, positioned right after 3 and enters Counter flow plate heat exchanger with bypass damper 8 or Rotary wheel with variable frequency drive (VFD) 9. After the fresh air recovers part of the heat/cool/humidity of the extract air, the air passes through Supply coil for additional fresh air treatment 12, which is connected to Internal Copper pipes connecting refrigerant circuit components within VMF unit 18. Supply air fan 10 is located before 12, which transports fresh air consecutively via Supply Air main ducts 54, Supply air regulating valve with actuator 50 to Internal Unit 42, and then through Supply air distribution ducts 49 and Supply air grilles 48 to the Conditioned Room 41.

The extract air from the room enters VMF consecutively, through Extract air grille(s) 52, Return air regulating valve with actuator 51 and through Return Air main ducts 55 1, via Return air inlet damper 5, which opens, closes and controls its quantity. Then the air goes into Return air inlet filter 7 for fine filtration and, then, into Counter flow plate heat exchanger with bypass damper 8 or Rotary wheel with variable frequency drive (VFD) 9, where the air rejects part of its cool/heat/humidity. After that the air is sucked from Return air fan 11, which transports the return air from the conditioned room 41. Then the air goes through Extract coil for additional heat recovery 13 and is extracted into the atmosphere or sucked for additional heat/cool rejection in Evaporator/Condenser Coil (1 or 2 pcs.) 14 from Axial fan(s) for refrigerant circuit 15 and then finally is extracted into the atmosphere. The Return air inlet filter 7 are located inside BLDC scroll compressor(s) section 16, which together with Variable frequency drive(s) for BLDC scroll compressor(s) 17 provide and control the entire heating/cooling capacity of the system. The BLDC scroll compressor(s) 17 are located near 16 and through Electric and Communication (ModBus) lines 56 are connected to Intelligent Control Box (ICB)—Master Controller 21, which simultaneously controls VMF External Unit (1), all Internal Unit(s) 42 and THU 23. The treated refrigerant is transported to THU 23 via Refrigerant inlet/outlet valves 19 and External Refrigerant copper pipes, connecting VMF unit and THU 22.

Power supply electric box 380V 20, which provides electric power supply for VMF External 1 is mounted after Extract coil for additional heat recovery 13. Evaporator/Condenser Coil (1 or 2 pcs.) 14, where processes of condensation or evaporation occur, is coupled to axial fan(s) for refrigerant circuit 15 configured to extract the mixture of fresh and air from the room to the atmosphere are located after Power supply electric box 380V 20 in the back of the Body (Aluminum frame and insulated panels) 2 housing Evaporator/Condenser Coil (1 or 2 pcs.) 14, where processes of condensation or evaporation occur and after that the axial fan(s) for refrigerant circuit 15 extract the mixture of fresh and air from the room to the atmosphere.

In FIG. 2, the IHU 23 is always positioned/installed in Machinery room inside of Building 39 and always between VMF External Unit 1 and Internal Units 42. The connection with 1 is done by External Refrigerant copper pipes, connecting VMF unit and IHU 22 and with Internal Units 42 is done by Water inlet/outlet pipes 40. Main component in IHU 23 is Refrigerant/Water plate heat exchanger 24, where the transformation of useful heat/cold of refrigerant to water occurs. On the refrigerant side entrance is located Electronic Expansion valve 25, which regulates the quantity of refrigerant and respective the cooling/heating capacity of the whole concept. On the water side entrance is located IHU circulation pump 27. Through three-way mixing valve with actuator 34 it sucks the water from both: 1, Hot water tank 36, via DHW return pipe 38 and from 2. Internal Units 42 via Water inlet/outlet pipes 40 and Gathering water collector 30. From water side outlet, the water through two-way regulating valve 35 goes Distribution water collector 29 and via DHW supply pipe 37 and finally reaches Hot water tank 36. Between Gathering water collector 30 and Distribution water collector 29 is located Balance valve (manual) 32 or two-way balance valve with actuator 33, depending on the functionality of the system (with or without functionality of DHW). The entire IHU 23 is controlled by THU Controller-slave 26 and the connections between main components are done by Electric and Communication (ModBus) lines 56.

In FIG. 4, Internal Units 42 provide cooling/heating of the conditioned room 41. It is designed for internal mounting inside the conditioned room 41. Each internal unit has the following components/executive mechanisms that are attached/mounted to it: two-way regulating valve with actuator 45 which controls the quantity of water entering the unit. The unit is connected to IU Controller-slave 43 through Electric and Communication (ModBus) lines 56 mounted on the front service side. It is specifically designed for control of the Internal unit 42. The IU Controller-slave 43 is connected to the controller of the next internal unit through Electric and Communication (ModBus) lines 56 and to Intelligent Control Box (ICB)—Master Controller 21. Supply air distribution ducts 49 through which the air enters Supply air grilles 48 are mounted on the outlet side of the unit. The grilles 48 distribute the air into the conditioned room. The internal unit Mixing Box 46 is located at the inlet side for mixing of fresh and recirculation air. Return air recirculation grill 47 is located on the bottom side of the mixing box. The Supply air regulating valve with actuator 50 that controls the exact supply air quantity is located on the side or top of the mixing box. The Extract air grille(s) 52 and Return air regulating valve with actuator 51 that controls the exact extract air quantity are located within the conditioned room. The valves 50 and 51 are linked to each other and to IU Controller-slave 43 via Electric and Communication (ModBus) lines 56. The Room Thermostat/Room Temperature sensor 53 may be mounted on some of the walls of the conditioned room so the users may set the desired room temperature and start/stop the internal unit.

It will be readily understood that the components of the application, as generally described and illustrated in the figures herein, may be arranged and designed in a wide variety of different configurations. Thus, the detailed description of the embodiments is not intended to limit the scope of the application as claimed but is merely representative of selected embodiments of the application.

One having ordinary skill in the art will readily understand that the above may be practiced with steps in a different order, and/or with hardware elements in configurations that are different than those which are disclosed. Therefore, although the application has been described based upon these preferred embodiments, it would be apparent to those of skill in the art that certain modifications, variations, and alternative constructions would be apparent.

While preferred embodiments of the present application have been described, it is to be understood that the embodiments described are illustrative only and the scope of the application is to be defined solely by the appended claims when considered with a full range of equivalents and modifications thereto.

What is claimed is:

1. A universal Variable Multi Flow (VMF) system, comprising:

a housing comprising a frame and a plurality of insulated panels;

a fresh air inlet damper configured to regulate an air flow;

a return air inlet damper;

a fresh air inlet filter coupled to the fresh air inlet damper;

a return air inlet filter coupled to the return air inlet damper;

a counter flow plate heat exchanger with a bypass damper configured to extract heat/humidity from air;

at least one supply and at least one return air fan configured to support circulation of the air through the VMF;

at least one condenser/evaporator coil configured to extract heat from ambient air and to serve as a refrigerant circuit;

a supply coil configured to re-cool or re-heat the air in separate enclosed areas; at least one brushless DC (BLDC) scroll compressor configured to produce warm or cold refrigerant;

at least one variable frequency drive configured to control capacity of the at least one BLDC scroll compressor; and a controller configured to control operations of the entire VMF system.

2. The VMF system of claim 1, further comprising an extract coil configured to additionally recover heat from enclosed areas.

3. The VMF system of claim 1, further comprising refrigerant inlet/outlet valves coupled to the at least one brushless DC (BLDC) scroll compressor.

4. The VMF system of claim 1, configured to simultaneously treat three independent fluids comprising water, refrigerant and air with a variable flow.

5. The VMF system of claim 1, further comprising an Internal Hydraulic Unit (IHU) configured to transfer the cool/heat of the refrigerant into water to prevent refrigerant from going into the conditioned rooms, wherein the IHU is controlled by an IHU Controller-slave.

6. The VMF system of claim 1 further configured to operate in cool-heat mode in different rooms simultaneously, wherein water is used for cooling and fresh air is used for heating when enclosed areas need to be heated.

7. The VMF system of claim 1 further configured to operate in heat-cool mode in different rooms simultaneously, wherein water is used for heating and fresh air is used for cooling when enclosed areas need to be cooled.

8. The VMF system of claim 1, further comprising Energy Management System (EMS) configured to measure in real-time measure and display any of:

an energy consumption of an entire system and energy consumption of all energy consuming components.

9. The VMF system of claim 1, comprising a controller configured to ensure Control of a temperature in conditioned rooms by controlling simultaneously both cooling/heating capacity and fresh air quantity and preventing manual speed control and cool/heat switch capability by users.

10. The VMF system of claim 1, further configured to activate a Emergency Mode when a water system stops cooling/heating of the water provided to internal units, wherein the internal units continue to work with a mixture of fresh air and recirculation air, and wherein the full capacity of the VMF is switched from water to fresh air and the system continues to operate until deactivation of the Emergency Mode.

11. The VMF system of claim 1 configured to execute heating and/or cooling operations and ventilation operation using up to 100% fresh air treatment and configured to work irrespective of concentration/content of CO2 in conditioned rooms, wherein the VMF operates with a maximum amount of fresh air calculated based on a maximum amount of people in the room.

12. The VMF system of claim 11 configured to perform each of the operations individually or simultaneously.

13. The VMF system of claim 11, wherein heating, ventilation and sanitary hot water operations are performed simultaneously through fine regulation and distribution of the water quantity and temperature between a heating system and a sanitary hot water system.

14. The VMF system of claim 11, wherein cooling, ventilation and sanitary hot water operations are performed simultaneously through maintaining and cooling of room's temperature by cooling the fresh air and producing sanitary hot water by the IHU.

15. The VMF system of claim 11 further configured to provide sanitary hot water production operation.

16. The VMF system of claim 15 configured to perform each of the operations individually or simultaneously.

17. A universal Variable Multi Flow (VMF) system, comprising:

a housing comprising a frame and a plurality of insulated panels;

a fresh air inlet damper configured to regulate an air flow;

a return air inlet damper;

a fresh air inlet filter coupled to the fresh air inlet damper;

a return air inlet filter coupled to the return air inlet damper;

a rotary wheel with variable frequency drive configured to extract heat or humidity from air;

at least one supply and at least one return air fan configured to support circulation of the air through the VMF;

at least one condenser/evaporator coil configured to extract heat from ambient air and to serve as a refrigerant circuit;

a supply coil configured to re-cool or re-heat the air in separate enclosed areas;

at least one brushless DC (BLDC) scroll compressor configured to produce warm or cold refrigerant;

at least one variable frequency drive configured to control capacity of the at least one BLDC scroll compressor; and a controller configured to control operations of the entire VMF system.

* * * * *